US005261357A

United States Patent [19]

Suh

[11] Patent Number: 5,261,357

[45] Date of Patent: Nov. 16, 1993

[54] LIGHTWEIGHT ENGINE BLOCK COOLING SYSTEM

[75] Inventor: Chung M. Suh, Ann Arbor, Mich.

[73] Assignee: Kia Motors Corporation, Seoul, Rep. of Korea

[21] Appl. No.: 832,437

[22] Filed: Feb. 7, 1992

[51] Int. Cl.[5] ..... F01P 9/04

[52] U.S. Cl. ..... 123/41.57

[58] Field of Search ..... 123/41.72, 41.74, 41.57, 123/195 R

[56] References Cited

U.S. PATENT DOCUMENTS

| | | | |
|---|---|---|---|
| 2,969,780 | 1/1961 | Wyczalek | 123/41.57 |
| 3,977,385 | 8/1976 | Mansfield | 123/195 R |
| 4,131,093 | 12/1978 | Mansfield | 123/41.57 |

FOREIGN PATENT DOCUMENTS

| | | | |
|---|---|---|---|
| 59-208145 | 11/1984 | Japan | 123/41.57 |

*Primary Examiner*—Noah P. Kamen

*Attorney, Agent, or Firm*—Bielen, Peterson & Lampe

[57] ABSTRACT

A lightweight engine block fabricated from a unitary, thermally conductive casting having at least one cylinder formed with a cylindrical wall in the casting with an upper cylinder section having an outer housing wall displaced from the cylinder wall around the upper cylinder section, wherein a reduced capacity annular water jacket is formed, and, a lower cylinder section having a plurality of outwardly directed cooling fins projecting from the cylinder wall at the lower cylinder section, wherein the cylinder is adapted to receive a piston and be enclosed by a cylinder head forming a combustion chamber with an upper high temperature section and a lower reduced temperature section, the upper high temperature section being encompassed by the upper cylinder section with the water jacket and the lower reduced temperature section being encompassed by the lower cylinder section with the cooling fins.

7 Claims, 2 Drawing Sheets

LIGHTWEIGHT ENGINE BLOCK COOLING SYSTEM

BACKGROUND OF THE INVENTION

This invention relates to a lightweight engine block having a hybrid cooling system that in part utilizes water cooling and in part utilizes air cooling to maintain normal thermal operating conditions in an engine. The lightweight engine block is a unitary casting that is fabricated from a thermally conductive material such as aluminum and is cast with one or more cylinders. Each cylinder is formed with a cylinder wall having an upper cylinder section with an outer housing wall displaced from the cylinder wall around the upper cylinder section forming a reduced-capacity, annular water jacket. A lower cylinder section has a plurality of outwardly directed cooling fins that project from the cylinder wall in alignment with the axis of the cylinder to both cool the lower portion of the cylinder and stiffen the fabricated casting.

Developing high performance, lightweight engines for use in automotive and other applications where fuel efficiency is a concern requires an integration of many diverse design factors from the outward configuration of a vehicle to reduce wind resistance, to the optimization of the vehicle power-weight ratio to enable an engine with the necessary power to drive a vehicle of a given weight. Although reduction in the weight of the engine does not affect engine performance for stationary power systems, where engine weight reduction is achieved in part by reducing the size and power consumption of auxilliary components, such as engine driven cooling water pumps, then operating efficiencies can rise in stationary as well as automotive systems.

Therefore, design of both the of the engine and its auxiliary components becomes an important factor in determining the performance criteria of the engine.

It is the object of this invention to provide an engine block that integrates a liquid cooling system with an air cooling system such that reduced capacity radiator, pump and conduit components can be utilized with the block when assembled into an operating engine. The engine block devised has particular application in a lightweight fuel efficient vehicle, but may also be used as a stationary power source for electrical generation or other use where fuel-efficiency is desired.

SUMMARY OF THE INVENTION

This invention relates to an engine block that is cast to include a hybrid cooling system that integrates a reduced capacity liquid coolant structure with an air cooling structure. The engine block is constructed with one or more cylinders that are adapted to each receive a reciprocating piston. The block has a flat top that is constructed to receive a capping head such that one or more combustion chambers are formed by the head, the cylinders and the pistons.

The construction of the engine block is such that a cooling jacket is formed around the top portion of the cylinder where combustion temperatures are at a maximum during initial ignition and high pressure burning of ignited gases. As the piston displaces from a top dead center and combustion gases are allowed to expand and cool, the newly exposed wall of the cylinder is subjected to lower temperature gases. Further, because of the periodic covering by the piston, a lower temperature is naturally maintained in the lower portion of the cylinder which is in a range suitable for air cooling structures.

In designing air cooling structures, the use of cooling fins is well-known. Customarily, such fins are horizontally arranged in planes perpendicular or transverse to the axis of the cylinder. However, by arranging the fins vertically or in planes parallel to the axis, the fins can provide the dual function of cooling and structural reinforcement.

The hybred cooling system allows reduction in the liquid coolant system, permitting use of a smaller radiator, a smaller capacity cooling pump and, smaller diameter conduits. The coolant capacity can be reduced by one third to one half and in addition to component cost and weight saving, the power loss from driving the water pump is reduced.

These and other advantages will become apparent from a detailed consideration of the preferred embodiments.

DESCRIPTION OF THE PREFERRED EMBODIMENTS

Figure 1:
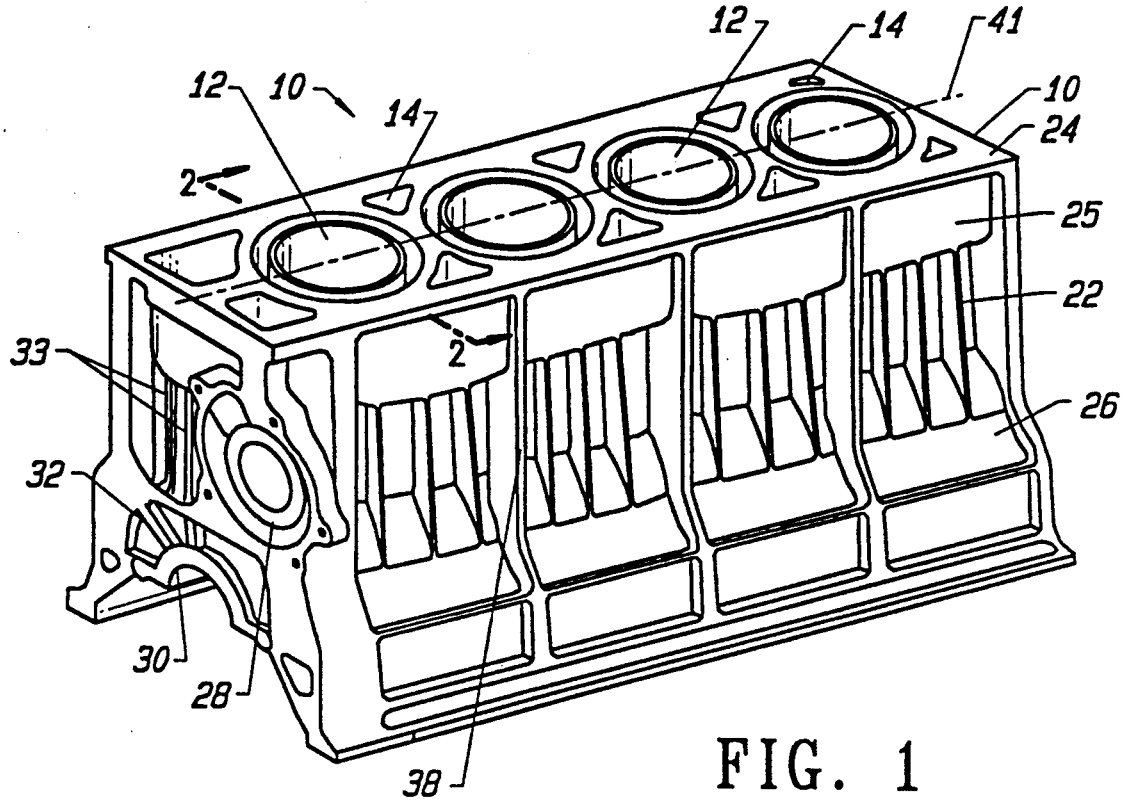
FIG. 1 is a perspective view of the engine block of this invention.

Referring to FIG. 1, an engine block, designated generally by the reference numeral 10, is shown with four cylinders 12 in which pistons (not shown) are reciprocal for the development of power to a crank shaft (not shown). Although the engine block 10 is primarily designed for use in an automotive vehicle, the block can be used in other applications such as a stationary power source and may be configured with any number of cylinders in a straight line or "V" configuration. The unique construction of the engine block 10 has been devised to minimize the weight of the engine and reduce the size of auxiliary components that are utilized to maintain the engine at an appropriate operating temperature. In this manner, the engine block 10 has a hybrid cooling system combining both water cooling and air cooling to minimize the size and capacity of auxiliary components such as the radiator, fuel pump and coolant conduits associated with the water cooling system of a conventional internal combustion engine.

Figure 2:
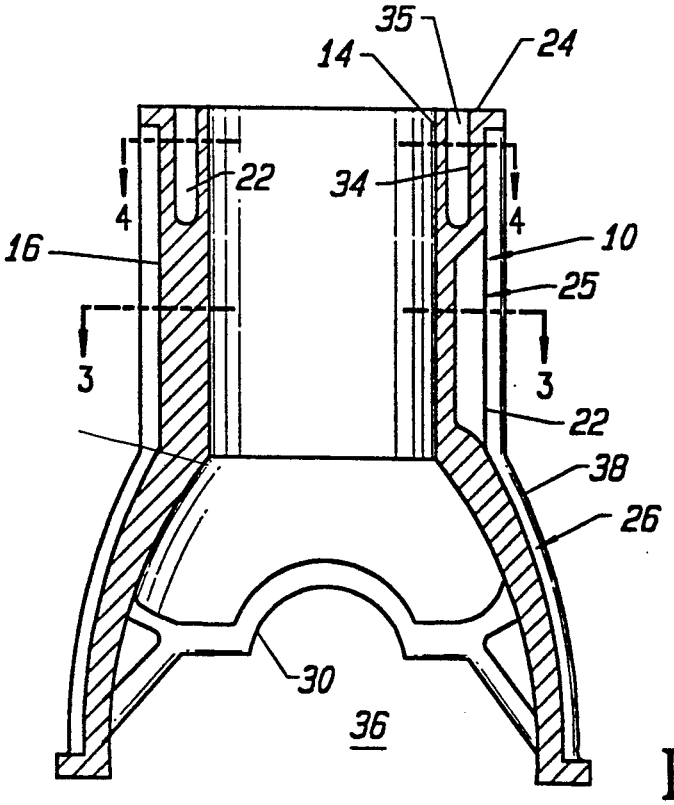
FIG. 2 is a vertical staggered cross-sectional view taken on the lines 2—2 in FIG. 1.

The engine block 10 is fabricated with cylinders 12 having a cylindrical wall 14 in the casting as shown in the cross-sectional view of FIG. 2. The cylindrical wall 14 has an upper cylinder section 16 with a water jacket 18 and a lower cylinder section 20 having a plurality of outwardly directed cooling fins 22.

The engine block 10 is otherwise conventional in configuration with a flat top 24 on which a covering engine block head (not shown) is mountable which, in conjunction with the top of the piston and wall of the piston cylinder, forms a combustion chamber for the combustion of fuel. The engine block 10 is cast to form a unitary cylinder housing 25 and bell-shaped crankcase housing 26. An oil pan assembly (not shown) for containing oil is connected to the crankcase housing 26 and houses a crank shaft and piston rod assembly in a conventional manner. The front wall 27 of the engine block 10 has a cast-in mount 28 for a reduced-size water pump and fan assembly (not shown). The casting for the front wall includes one half of the bearing housing 30 that supports the main bearing of the crank shaft. The rear bearing housing 30 is visible in the cross sectional view of FIG. 2. Webbed ribs 32 provide the necessary strength for the casting of the front wall of engine block 10. As shown in FIG. 1, the engine block may include cooling fins 33 in front of wall 27 which assist in cooling the cylinders and in addition provide strengthing ribs for the casting.

As shown in the cross-sectional view of FIG. 2, taken in part along the center line of one of the cylinders and staggered to show the profile of the fin 22, the water jacket 18 extends from the top of the engine block to approximately one third the length of the cylinder 12, which is approximately one half the depth of the combustion chamber with the piston at bottom dead center. The cylindrical wall 14 comprises an inner wall that together with a concentric outer wall 34 forms the annular coolant chamber 35 around the upper cylinder section 16.

Figure 5:
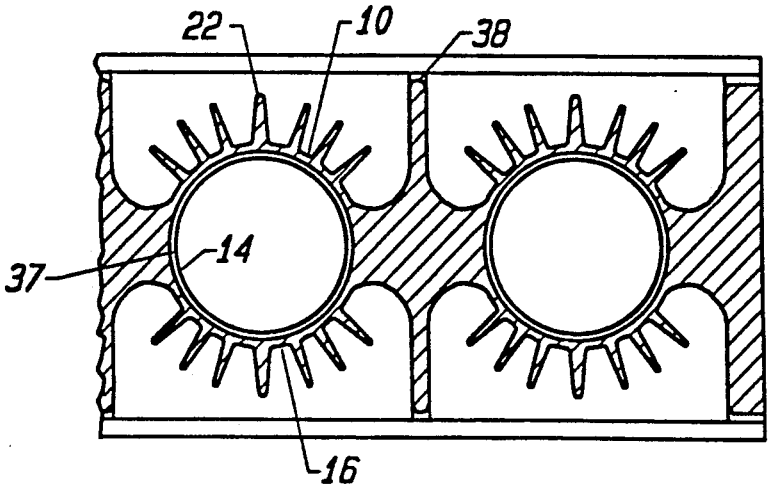
FIG. 5 is a partial horizontal cross-sectional view of an alternate vertical cooling fin configuration.

The cast engine block, as shown in FIG. 2, forms a housing 25 for the piston cylinders 12 and a housing 26 for the crankcase chamber 36. When the engine block 10 is cast from a soft metal such a aluminum, the cylinder wall 14 may include an alloy liner or sleeve 37 to control wear, as shown in the alternate configuration of the upper cylinder section 16 shown in FIG. 5.

Figure 3:
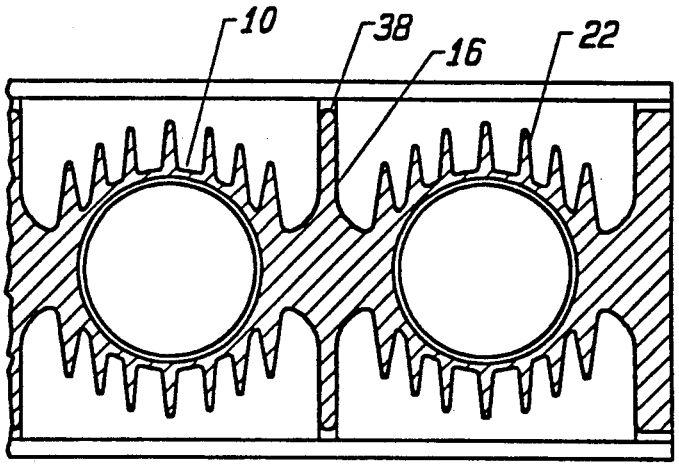
FIG. 3 is a partial horizontal cross-sectional view taken on the lines 3—3 in FIG. 2.
Figure 4:
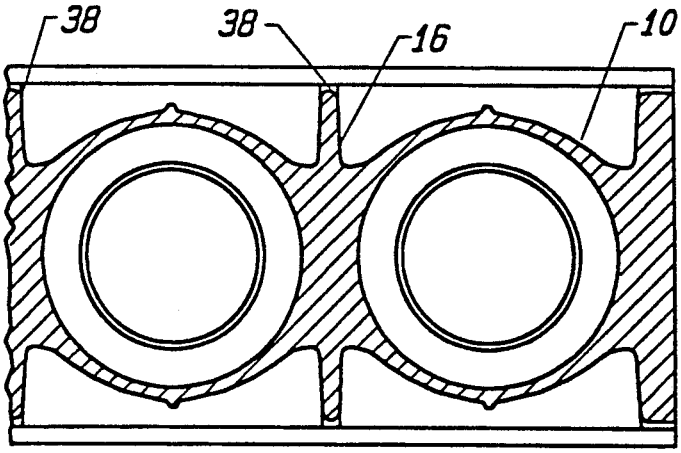
FIG. 4 is a partial horizontal cross-sectional view taken on the lines 4—4 in FIG. 2.

To minimize the weight of the cast block while maximizing strength, the housing 34 includes a series of reinforcing ribs 38 between adjacent cylinders 12. The reinforcing ribs 38 extend from the flat top 24 of the engine block to the bell housing 26 forming part of the crank-case chamber 36. The profile of the reinforcing ribs 38 is shown in the cross-section of FIG. 2. Between the reinforcing ribs 38 are located the cooling fins 22 which are oriented parallel to the axis of the cylinders 12 and add additional strengthening to the structure of the engine block 10. The cooling fins 22 extend between the bottom of the outer wall 34 of the water jacket 18 to the bell housing 26 as shown in the additional partial cross-sectional view of FIG. 3. In this manner, the wall thickness required to withstand the side thrust of piston motion can be minimized with a resulting reduction in the weight of the engine block casting. As shown in the cross-sectional view of FIGS. 4 and 5, the fins can be either oriented transverse to the centerline 41 of the aligned cylinders 12 as shown in FIG. 3, or radial to the cylinder axis as shown in FIG. 4. Although the radial orientation of the fins 22 is more effective for thermal dissipation, the configuration requires that the engine block be cast from sand casting techniques since the fin orientation renders the design unsuitable for pressure mold castings. In the configuration where the fins are transverse to the aligned cylinders, the arrangement is equivalent to parallel fins having planes parallel to the axis of the cylinder, a description suitable to distinguish the orientation of fins in a single cylinder engine from the radially directed arrangements.

Referring to FIG. 4, the cross-section of the engine block at the water jacket 18 is shown. As the depth of the water jacket 18 is limited to the upper cylindrical section 16 of the cylinder 12 as shown in FIG. 2, the capacity is substantially reduced thereby reducing the radiator size and water pump size. Reduction in the water pump size causes a resultant reduction in demand on engine power for circulating cooling water. The cooling fins not only dissipate heat from the lower cylinder section 20, but aid in dissipating thermal build-up in other section of the engine block thereby further reducing the burden on the circulating cooling water. Because of their orientation in planes parallel to the axis at the cylinder in both preferred embodiments, the cooling fins serve as stiffeners to the engine block enabling the engine block to be cast with less material for both material cost savings and weight reduction. These and other features combine to form an efficiently designed engine block that is suitable for automotive and other applications.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lightweight engine block comprising:

a thermally conductive casting forming a unitary cylinder housing and a bell-shaped, crankcase housing, the cylinder housing having at least one piston cylinder with a center axis and a cylindrical inner wall constructed to receive a reciprocating piston therein, the piston and cylinder defining a combustion chamber with a changeable volume when a piston reciprocates between a top dead center position and a bottom dead center position, the cylinder housing having an upper, liquid-cooled, cylinder section and a lower, air-cooled, cylinder section, wherein the upper cylinder section has a finless outer housing wall displaced from the cylinder wall, wherein a water jacket is formed between the inner cylinder wall and the outer housing wall around the combustion chamber above the bottom dead center position of a piston reciprocal in the cylinder, the water jacket having liquid cooling means for cooling the upper cylinder section, and, wherein the lower cylinder section has a plurality of outwardly directed cooling fins wherein the cooling fins extend between the outer housing wall of the upper cylinder section of the cylinder housing and the bell-shaped, crankcase housing wherein the fins are parallel to the center axis of the cylinder and both reinforce the engine block casting and cool the lower cylinder section.

2. The lightweight engine block of claim 1 wherein the cooling fins are planar and parallel with one another.

3. The lightweight engine block of claim 1 wherein the thermally conductive casting includes a plurality of piston cylinders in the cylinder housing.

4. The lightweight engine block of claim 1 wherein the the cooling fins are planar and radially oriented relative to the axis of the cylinder.

5. The lightweight engine block of claim 1 comprising further, reinforcing ribs, wherein the cylinder housing has a flat top and the reinforcing ribs extend between the flat top of the cylinder housing and the bell-shaped, crankcase housing.

6. The light weight engine block of claim 5 wherein the cylinder housing includes a plurality of cylinders and the reinforcing ribs are spaced between cylinders and aligned with the center of the cylinders.

7. The lightweight engine block of claim 6 wherein the cooling fins are positioned between reinforcing ribs.

* * * * *